US009806461B2

(12) United States Patent
Xu et al.

(10) Patent No.: US 9,806,461 B2
(45) Date of Patent: Oct. 31, 2017

(54) CARD EDGE CONNECTOR HAVING IMPROVED EJECTOR

(71) Applicant: FOXCONN INTERCONNECT TECHNOLOGY LIMITED, Grand Cayman (KY)

(72) Inventors: Qin Xu, Kunshan (CN); Hung-Chi Yu, New Taipei (TW); Zhen-Hua Wang, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/206,516

(22) Filed: Jul. 11, 2016

(65) Prior Publication Data

US 2017/0012390 A1 Jan. 12, 2017

(30) Foreign Application Priority Data

Jul. 10, 2015 (CN) ..... 2015 2 0495771 U

(51) Int. Cl.
*H01R 13/629* (2006.01)
*H01R 12/73* (2011.01)

(52) U.S. Cl.
CPC ..... *H01R 13/62955* (2013.01); *H01R 12/737* (2013.01)

(58) Field of Classification Search
CPC ..... H01R 13/629; H01R 13/62961; H01R 13/633; H01R 13/62955
See application file for complete search history.

(56) References Cited

U.S. PATENT DOCUMENTS 4,447,101 A * 5/1984 Gugliotti ..... H01R 13/633 439/153
5,057,029 A * 10/1991 Noorily ..... H01R 13/633 439/157
6,176,714 B1 * 1/2001 Ishida ..... G06K 13/08 439/159
7,866,995 B1 * 1/2011 Kudo ..... H01R 12/721 439/157

(Continued)

FOREIGN PATENT DOCUMENTS

TW M472334 U 2/2014

*Primary Examiner* — Briggitte R Hammond
(74) *Attorney, Agent, or Firm* — Wei Te Chung; Ming Chieh Chang

(57) ABSTRACT

A card edge connector includes an elongated insulative housing, a number of contacts retained in the insulative housing, and an ejector received in the insulating housing for locking with a memory card. The insulative housing includes a passageway and at least one tower portion extending upwardly from an end thereof. The tower portion has a two opposite side walls, and a middle wall located between two side walls. The ejector has a base portion defining a lower ejecting section, a locking portion defining a locking section, and a narrowed reinforcing portion formed between the base portion and the locking portion. The narrowed reinforcing portion being thinner than the base portion and the locking portion, and the middle wall has a narrowed slot communicating with the elongated passageway to permit the narrowed reinforcing portion to rotate inward to lower a height of the card edge connector.

17 Claims, 8 Drawing Sheets

(56) References Cited

U.S. PATENT DOCUMENTS

| | | | | |
|---|---|---|---|---|
| 7,955,099 | B2 * | 6/2011 | Tan | H01R 13/62988 439/157 |
| 8,602,677 | B2 * | 12/2013 | Peng | G06F 1/185 361/801 |
| 8,753,138 | B2 * | 6/2014 | Foster, Sr. | H01R 12/7029 439/160 |
| 2012/0329301 | A1 * | 12/2012 | Li | H01R 12/721 439/157 |
| 2013/0130526 | A1 * | 5/2013 | Mo | H05K 7/1431 439/157 |
| 2014/0170875 | A1 * | 6/2014 | Shen | H01R 12/7005 439/159 |

* cited by examiner

CARD EDGE CONNECTOR HAVING IMPROVED EJECTOR

BACKGROUND OF THE INVENTION

1. Field of the Invention

The present invention relates to a card edge connector, and more particularly to a low height card edge connector having an improved ejector.

2. Description of the Related Art

Taiwan Pat. No. M472334, issued on Feb. 11, 2014, discloses a reduced height card edge connector which includes an insulative housing extending in a longitudinal direction and a plurality of contacts received in the insulative housing. The insulative housing defines a central slot for inserting a memory card and a pair of tower portions for receiving a pair of ejectors. The tower portion defines a cavity and the ejector is rotatably attached to the cavity. A preventing portion is formed in the cavity. The ejector includes a main portion, an upper locking section, and a lower ejecting section. The ejector defines an hole running through opposite sides of the main portion in the longitudinal direction for the ejector to pass through during rotating inward. Thus, the card edge connector has a low height.

However, the hole provided on the main portion weakens the structure of the ejector.

Therefore, an improved card edge connector are desired to overcome the disadvantages of the related arts.

SUMMARY OF THE INVENTION

An object of the present invention is to provide a card edge connector having a high strength ejector.

In order to achieve above-mentioned object, a card edge connector includes an elongated insulative housing, a plurality of contacts retained in the insulative housing, and an ejector received in the insulating housing for locking with a memory card. The insulative housing includes a passageway recessed downwardly from a top surface thereof and at least one tower portion extending upwardly from an end thereof. The tower portion has a two opposite side walls, and a middle wall located between two side walls. The ejector has a base portion defining a lower ejecting section, a locking portion defining a locking section, and a narrowed reinforcing portion formed between the base portion and the locking portion. The narrowed reinforcing portion is thinner than the base portion and the locking portion, and the middle wall has a narrowed slot communicating with the elongated passageway to permit the narrowed reinforcing portion to rotate inward. Thus, the height of the card edge connector can be reduced.

Other objects, advantages and novel features of the invention will become more apparent from the following detailed description of the present embodiment when taken in conjunction with the accompanying drawings.

DETAILED DESCRIPTION OF THE INVENTION

Figure 1:
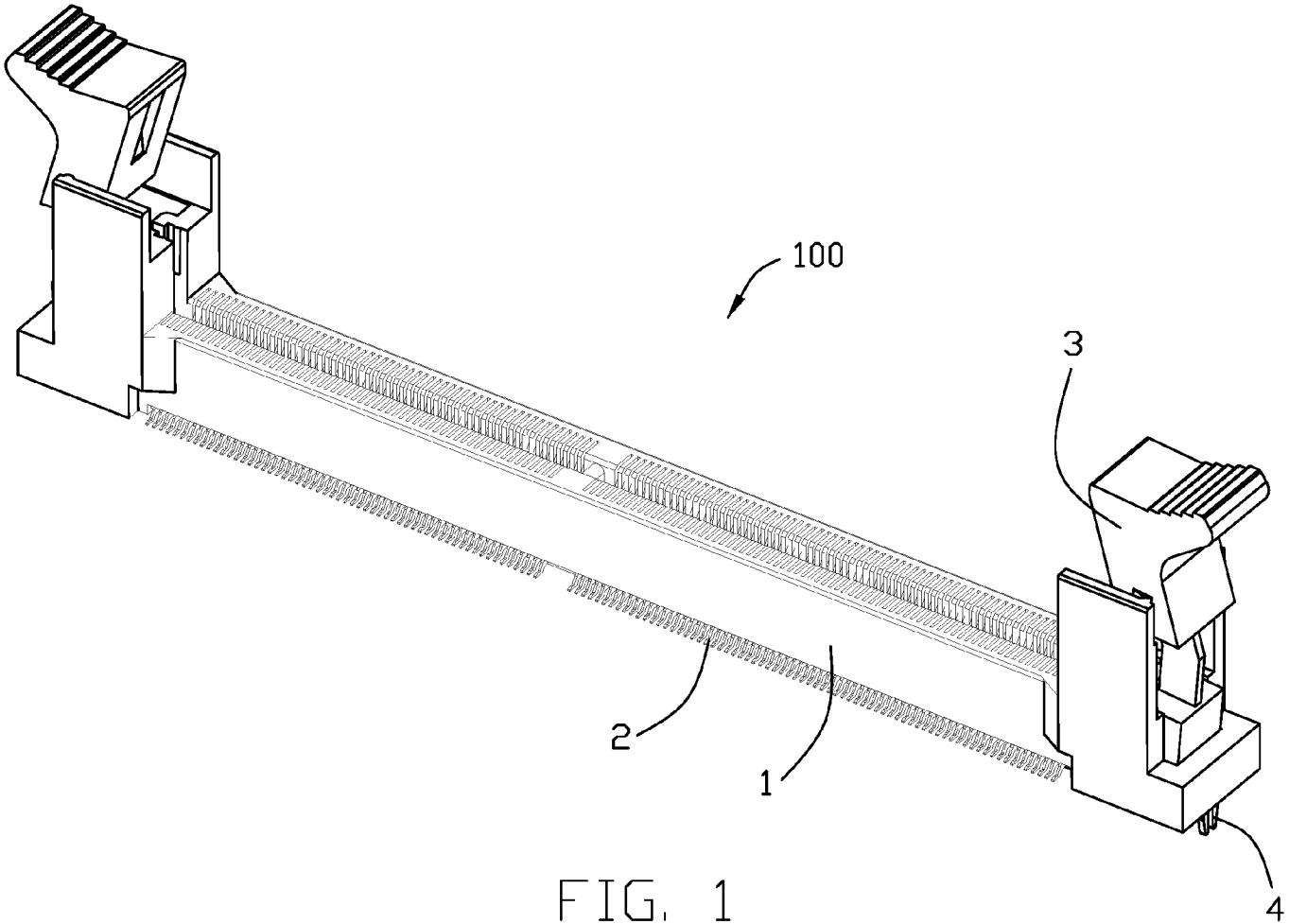
FIG. 1 is a perspective view of a card edge connector in accordance with the preferred embodiment of the present invention.

Reference will now be made to the drawing figures to describe the preferred embodiments of the present invention in detail.

Figure 2:
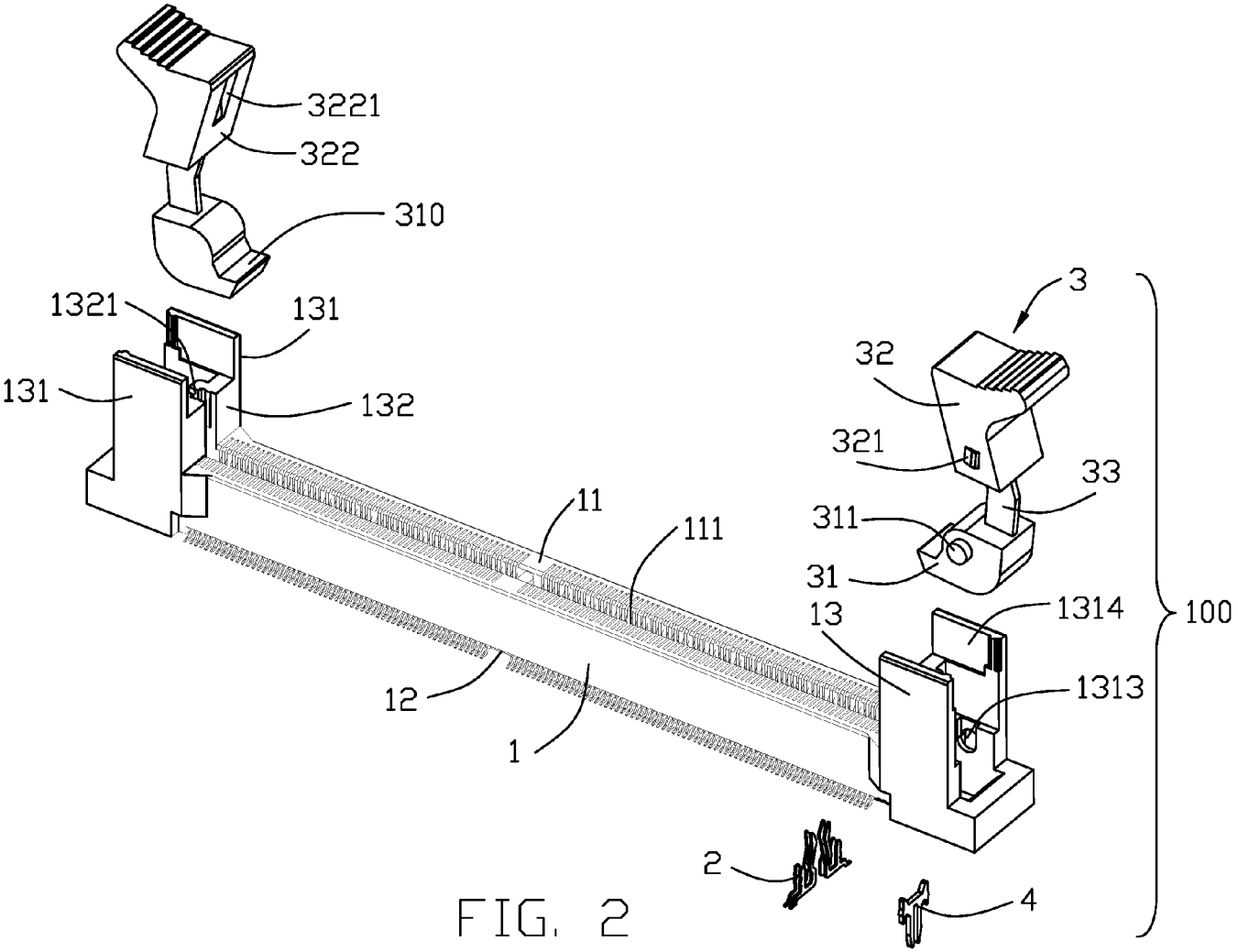
FIG. 2 is a partly exploded perspective view of the card edge connector of FIG. 1.

Referring to FIGS. 1 and 2, a card edge connector 100 is adapted to be mounted on a printed circuit board (PCB) (not shown) and then engage with a memory card (not shown) for interconnecting between both thereof. The card edge connector 100 includes elongated insulative housing 1 extending in a longitudinal direction, a plurality of contacts 2 are retained in the longitudinal insulative housing 1, an pair of ejectors 3 located at opposite ends of the insulative housing 1 in the longitudinal direction for latching with or ejecting the memory card (not shown), and a board lock 4 retained to the insulative housing 1 for retaining the card edge connector 100.

Figure 3:
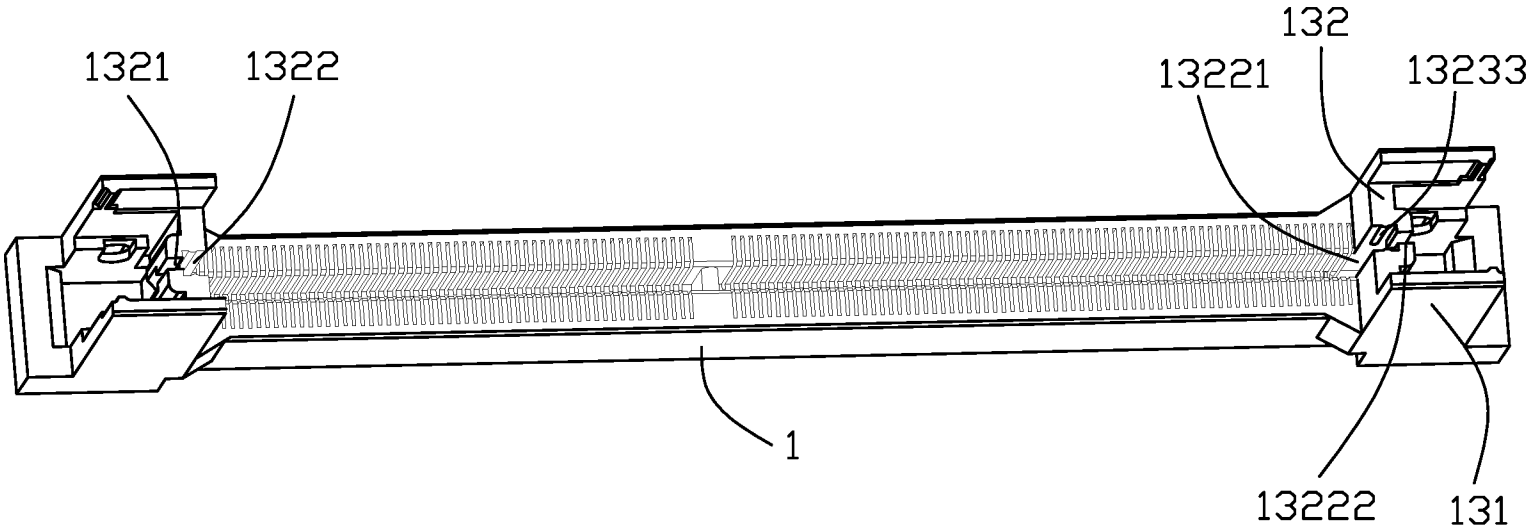
FIG. 3 is another perspective view of the card edge connector without the ejector shown in FIG. 1.
Figure 4:
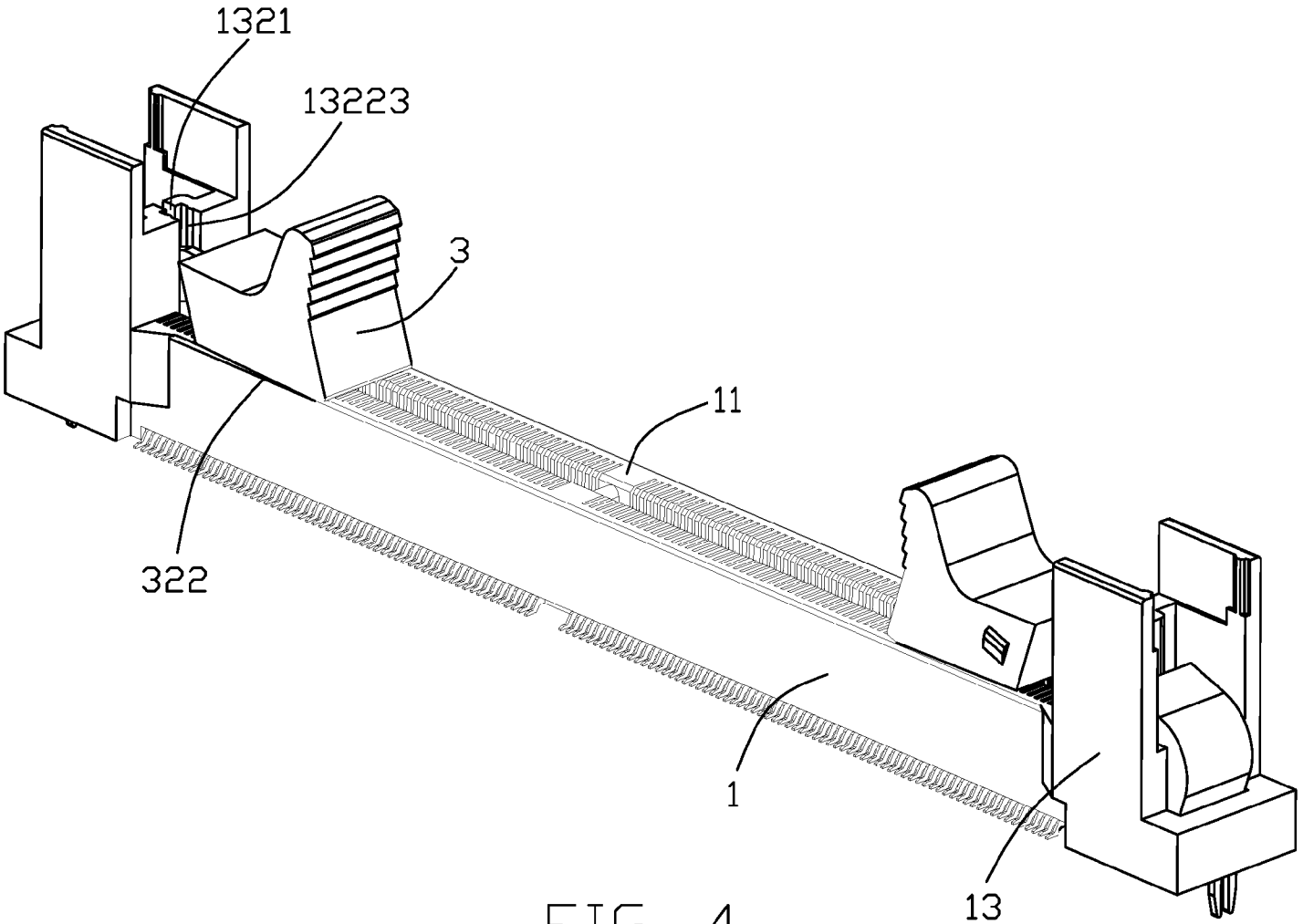
FIG. 4 is another perspective view of the card edge connector with the ejector lying down inward shown in FIG. 1.

Referring to FIGS. 3 and 4, the insulative housing 1 defines a top surface 11 and a bottom surface 12 opposite to the top surface 11, the insulative housing 1 defines a elongated passageway 11 recessed from the upper surface 11 thereof for insertion of the memory card (not shown), the board lock 4 is assembled to the bottom surface 12 of the insulative housing 1. The insulative housing 1 includes a pair of tower portions 13 extending upwardly from opposite ends thereof in the longitudinal direction, the tower portion 13 includes a pair of side walls 131 formed on opposite side of the insulative housing 1 in a lateral direction perpendicular to the longitudinal direction and a middle wall 132 located between two side walls 131 extending upwardly from the top surface 11 of the insulative housing 1. The middle wall 132 can also separate from the top surface 11. The ejector 3 is rotatably attached to the pair of side walls 131.

In order to reduce the whole height of the card edge connector 100, the middle wall 132 defines a narrowed slot 1321 communicating with the elongated passageway 11 for passing through the ejector 3 when the ejector 3 inwardly rotating. Specifically, the middle wall 132 has a concave portion 1322 defining a pair of retaining walls 13221 for retaining the memory card (not shown) in the lateral direction and a limiting wall 13222 formed between two retaining walls 13221 for limiting the memory card in the longitudinal direction. The width of two retaining walls 13221 is equal to the elongated passageway 11, the narrowed slot 1321 formed at the limiting wall 13222, the width between two retaining walls 13221 is wider than the narrowed slot 1321. In order to limit the memory card better, each retaining wall 13221 includes at least one rib 13223 formed on opposite inner walls thereof.

Figure 5:
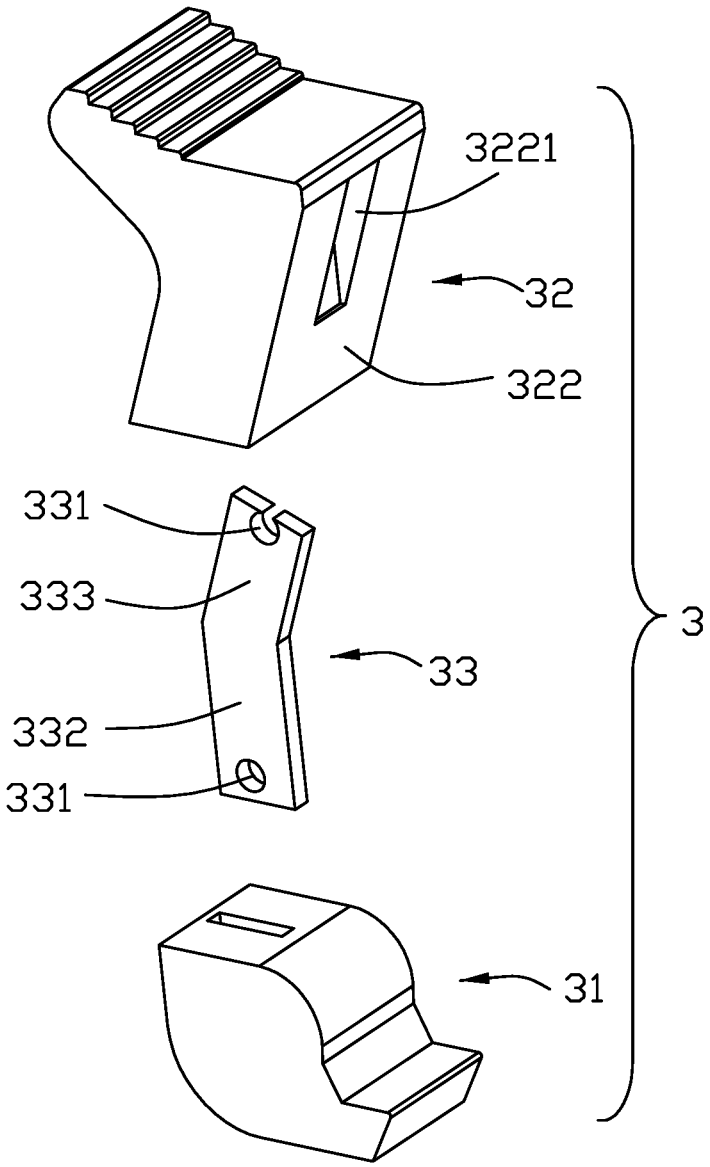
FIG. 5 is a partly exploded perspective view of the ejector of the card edge connector shown in FIG. 1.
Figure 6:
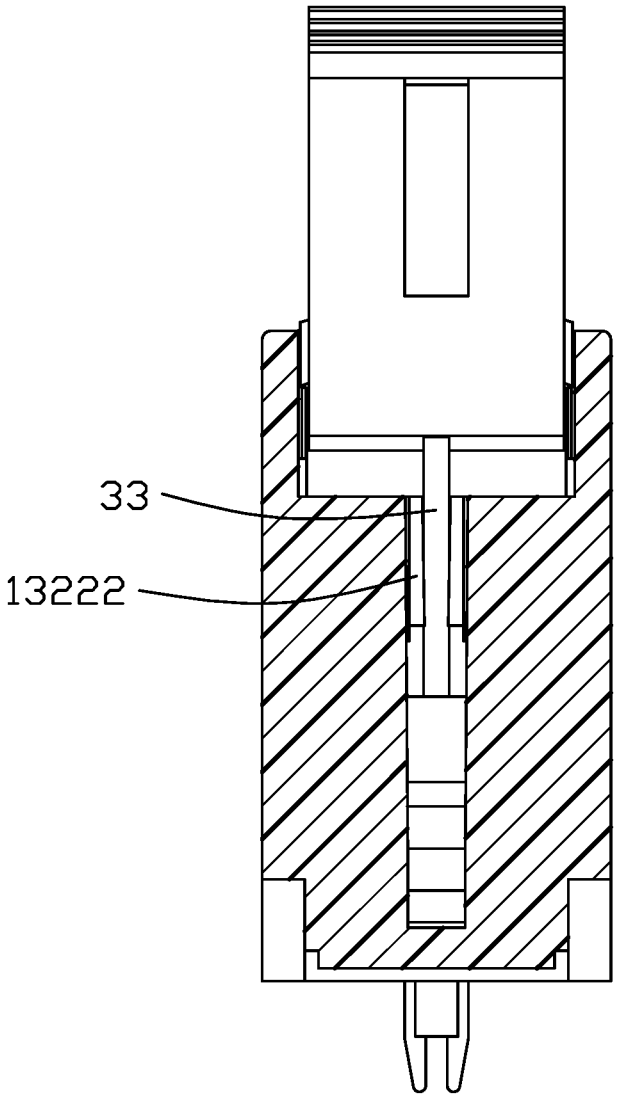
FIG. 6 is a partial cross-sectional view to show the limiting wall around the narrow slot of the card edge connector of FIG. 1.
Figure 7A:
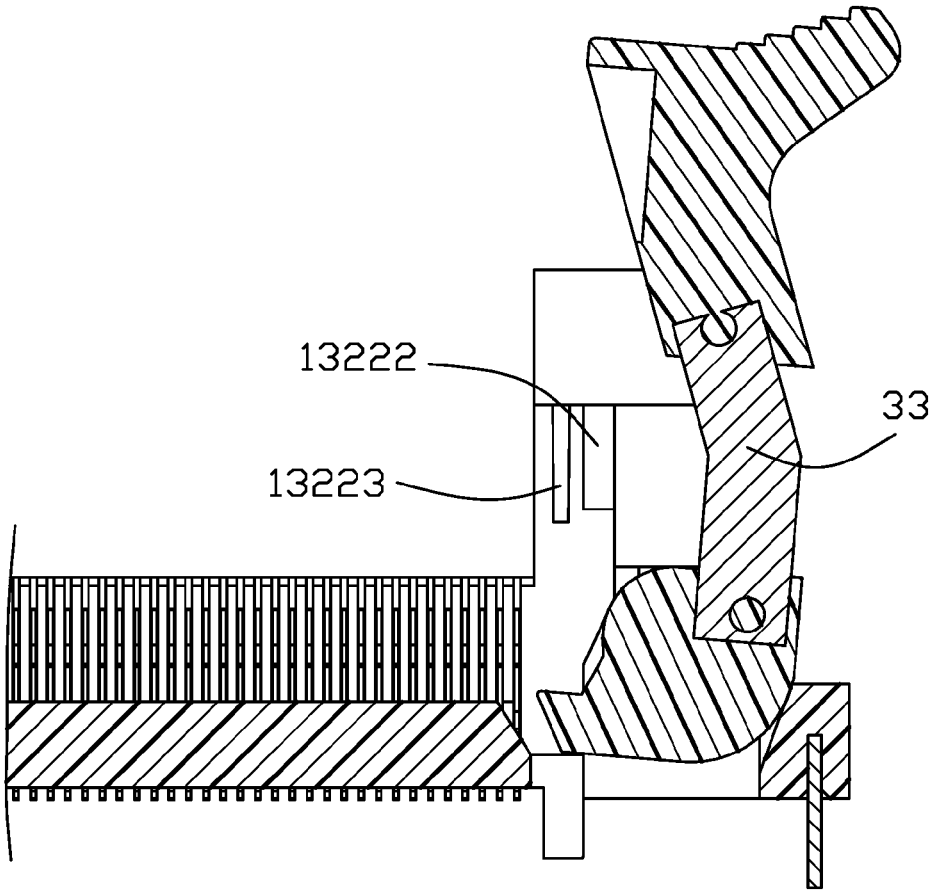
FIG. 7(A) is a partial cross-section view of the card edge connector of FIG. 1 when the ejector is in an upstanding state.
Figure 7B:
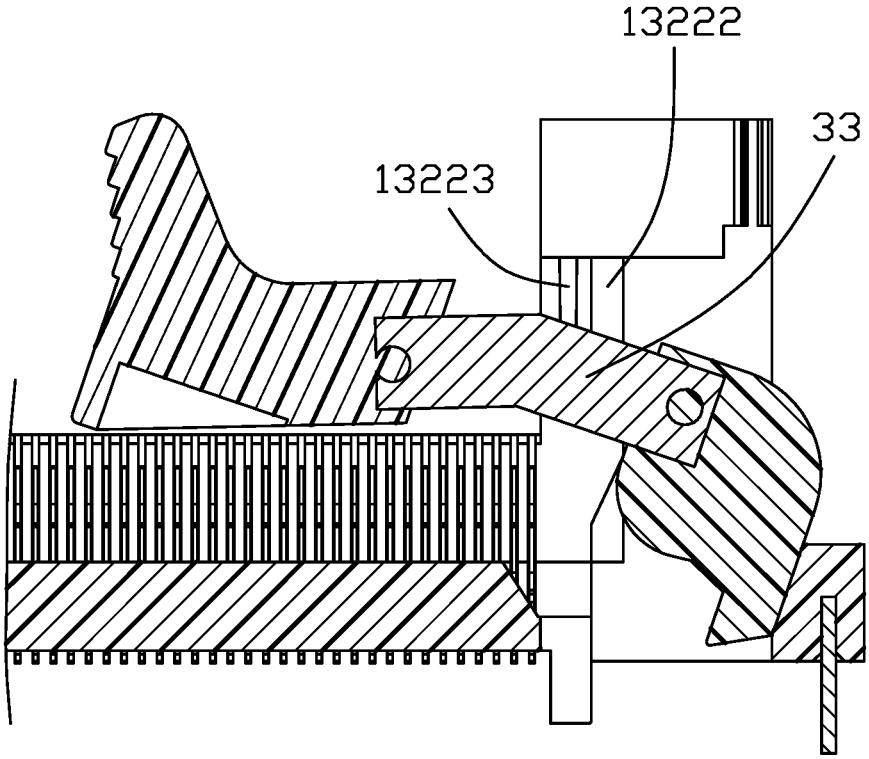
FIG. 7(B) is a partial cross-section view of the card edge connector of FIG. 1 when the ejector is in a lying state.

Referring to FIG. 5, the ejector 3 has a base portion 31 defining an ejecting section 310 extended from a lower end of the base portion 31, a locking portion 32 for locking with the memory card and a narrowed reinforcing portion 33 formed between the base portion 31 and the locking portion 32. The side wall 131 is taller than the middle wall 132, the locking portion 32 includes a bottom end above the middle wall 131 for the locking portion 32 passing through the middle wall 132. The narrowed reinforcing portion 33 is thinner than the base portion 31 and the locking portion 32, the width of the narrowed reinforcing portion 33 is less than or equal to the narrowed slot 1321 in the lateral direction for passing through the narrowed reinforcing portion 33 when the narrowed reinforcing portion 33 rotating inward. A pair of pivots 311 protruded from opposite sides of base portion 31 and a pair of protruding portions 321 protruded from opposite sides of the locking portion 32. Two side walls 131 of the tower portion 13 includes a pair of pivoting slots 1313 and retaining grooves 1314 cooperated with the corresponding pivots 311 and protruding portions 321 respectively.

The narrowed reinforcing portion 33 is a flat metal defining at least two holes 331 formed on opposite ends thereof respectively, the base portion 31 and the locking portion 32 are fixed to opposite ends of the narrowed reinforcing portion 33 respectively by insert molding. The holes 331 can increase the strength between the narrowed reinforcing portion 33 and the base portion 31, the narrowed reinforcing portion 33 and the locking portion 32. The narrowed reinforcing portion 33 can also made of other material if it has high strength.

Referring to FIGS. 3 and 4, the narrowed reinforcing portion 33 has a vertical portion 332 perpendicular to the top surface 11 of the insulative housing 1 and an inclined portion 333 extending inwardly from an upper end of the vertical portion 332. The base portion 31 combines with the vertical portion 332 and the locking portion 32 combines with the inclined portion 333. The locking portion 32 includes an inner surface 322 inwardly inclined to the top surface 11 of the insulative housing 1 and a locking section 3221 depressed from the inner surface 322 for locking with the memory card (no shown), the locking section 3221 is a locking groove. The inner surface 322 is parallel to the inclined portion, and thus the inner surface 322 can easily lie down on the top surface 11 when the ejector 3 rotating inward. It is noted that in this embodiment the limiting wall 13222 around the narrow slot 1321 retains the narrow reinforcing portion 33 in position when the ejector 3 is inwardly rotated to the lying position. Understandably, such retaining means may be formed on other positions of the housing It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. A card edge connector comprising:

an elongated insulative housing having an elongated passageway recessed downwardly from a top surface thereof and at least one tower portion extending upwardly from an end thereof;

a plurality of contacts retained in the insulative housing; and an ejector rotatably attached to the at least one tower portion; wherein the at least one tower portion has two opposite side walls and a middle wall, the ejector has a base portion defining a lower ejecting section, a locking portion defining a locking section, and a narrowed reinforcing portion formed between the base portion and the locking portion, the narrowed reinforcing portion being thinner than the base portion and the locking portion, and the middle wall has a narrowed slot communicating with the elongated passageway to permit the narrowed reinforcing portion to rotate inward.

2. The card edge connector as described in claim 1, wherein the width of the narrowed reinforcing portion is less than or equal to the narrowed slot in a lateral direction.

3. The card edge connector as described in claim 1, wherein a pair of pivots and a pair of protruding portions are formed on opposite sides of the base portion and the locking portion, respectively, and the pair of side walls of the tower portion includes a pair of pivoting slots and a pair of retaining grooves cooperating with the pivots and the protruding portions, respectively.

4. The card edge connector as described in claim 1, wherein the narrowed reinforcing portion is a flat metal defining at least two holes formed on opposite ends thereof, the base portion and the locking portion are insert molded to opposite ends of the narrowed reinforcing portion, respectively.

5. The card edge connector as described in claim 4, wherein the side wall of the tower portion is taller than the middle wall, and the locking portion includes a bottom end above the middle wall.

6. The card edge connector as described in claim 4, wherein the locking portion includes an inner surface inwardly inclined to the top surface of the insulative housing and the locking section is a locking groove depressed from the inner surface.

7. The card edge connector as described in claim 4, wherein:

the middle wall includes a concave portion for receiving a memory card, the concave portion having a pair of retaining walls and a limiting wall formed between the two retaining walls; and the narrowed slot formed at the limiting wall.

8. The card edge connector as described in claim 7, wherein a width between the two retaining walls is wider than the narrowed slot.

9. The card edge connector as described in claim 8, wherein each retaining wall has at least one rib formed on an inner wall thereof.

10. The card edge connector as described in claim 4, wherein the narrowed reinforcing portion has a vertical portion perpendicular to the top surface of the insulative housing and an inclined portion extending inwardly from an upper end of the vertical portion, and the base portion combines with the vertical portion and the locking portion combines with the inclined portion.

11. The card edge connector as described in claim 10, wherein the locking portion includes an inner surface inwardly inclined to the top surface of the insulative housing and the locking section is a locking groove depressed from the inner surface.

12. The card edge connector as described in claim 11, wherein the inner surface of the locking portion is parallel to the inclined portion.

13. A card edge connector comprising:

an insulative elongated housing defining a receiving slot in a longitudinal direction with two towers at two opposite ends thereof, each of said tower forming a middle wall facing the receiving slot and a pair of side walls to commonly form a receiving cavity;

a plurality of contacts disposed in the housing and by two sides of the receiving slot; and at least one ejector pivotally disposed in the receiving cavity of one of said towers and including an insulative upper locking portion with an upper locking section for locking the memory module, and an insulative lower base portion with a lower ejecting section for ejecting the memory; wherein said upper locking portion and said lower ejecting portion is spaced from each other while being linked by a narrowed reinforcing portion which extends through a narrowed slot in the middle wall so as to allow the ejector to be inwardly rotated toward a lying position.

14. The card edge connector as claimed in claim 13, wherein the middle wall forms a limiting wall around the narrowed slot to retain the ejector in position when said ejector is moved to the lying position.

15. The card edge connector as claimed in claim 13, wherein said lower base portion is pivotally mounted upon the tower.

16. The card edge connector as claimed in claim 13, wherein said upper locking portion further forms a protruding portion for retaining the ejector in position when the ejector is in an upstanding position, and the lower base portion forms a pivot thereon for pivotally mounting the ejector upon the tower.

17. The card edge connector as claimed in claim 13, wherein said narrowed reinforcing portion is made of metal.

* * * * *